US005875824A

United States Patent [19]

Atwell et al.

[11] Patent Number: 5,875,824

[45] Date of Patent: Mar. 2, 1999

[54] METHOD AND APPARATUS FOR HIGH SPEED DELIVERY OF PARTICULATE MATERIAL

[76] Inventors: Charles G. Atwell, Rte. 9 Box 18, Mechanicsville, Va. 23111; Marc D. Belcastro, 11414 Colfax Rd., Glen Allen, Va. 23060; Joseph F. Budjinski, II, 228 Sherwood Dr., Quinton, Va. 23141; Jörg Förster, 4764 Charles City Rd., Richmond, Va. 23231; Martin T. Garthaffner, 5200 Newbyswood Trail, Chesterfield, Va. 23832; Alfred Hinzmann, 5534 Country Club Way, Sarasota, Fla. 34243; Wilfried Hoffman, 11620 Old Lewiston Rd., Richmond, Va. 23236

[21] Appl. No.: 692,550

[22] Filed: Aug. 6, 1996

[51] Int. Cl.[6] ..... B65B 1/04; B65B 3/04

[52] U.S. Cl. ..... 141/67; 141/125; 141/144; 141/286

[58] Field of Search ..... 141/67, 11, 12, 141/70, 71, 81, 86, 93, 121–123, 125, 129, 144, 286, 290; 222/368, 152, 636

[56] References Cited

U.S. PATENT DOCUMENTS

| | | | |
|---|---|---|---|
| 3,312,151 | 4/1967 | Molins | 93/1 |
| 3,312,152 | 4/1967 | Williamson | 141/129 |
| 3,340,775 | 9/1967 | Raymond et al. | 93/1 |
| 3,348,455 | 10/1967 | Williamson et al. | 93/1 |
| 3,550,508 | 12/1970 | Wartman et al. | 93/1 |
| 3,570,557 | 3/1971 | Mollins | 141/129 |
| 3,623,404 | 11/1971 | Jackson | 493/48 |
| 3,625,118 | 12/1971 | Jackson | 93/1 |
| 3,807,286 | 4/1974 | Sexstone | 93/1 |
| 3,844,200 | 10/1974 | Sexstone | 93/1 |
| 3,884,741 | 5/1975 | Sexstone | 156/259 |
| 3,943,832 | 3/1976 | Sexstone | 93/1 |
| 3,957,563 | 5/1976 | Sexstone | 156/438 |
| 4,005,668 | 2/1977 | Washington et al. | 141/67 |
| 4,016,830 | 4/1977 | Sexstone | 118/406 |
| 4,020,881 | 5/1977 | Nothen | 141/125 |
| 4,090,424 | 5/1978 | Hall | 83/330 |
| 4,106,535 | 8/1978 | Davis | 141/125 |
| 4,174,720 | 11/1979 | Hall | 131/90 |
| 4,184,412 | 1/1980 | Hall | 93/1 |
| 4,208,956 | 6/1980 | Hall | 93/77 |
| 4,214,508 | 7/1980 | Washington | 93/1 |
| 4,412,829 | 11/1983 | Lebet et al. | 493/48 |
| 4,425,107 | 1/1984 | Hall | 493/48 |
| 4,861,324 | 8/1989 | Hirose et al. . | |
| 4,949,766 | 8/1990 | Coatsworth | 141/67 |
| 5,322,495 | 6/1994 | Budjinski et al. | 493/48 |

*Primary Examiner*—Steven O. Douglas
*Attorney, Agent, or Firm*—Charles E. B. Glenn; James E. Schardt; James T. Moore

[57] ABSTRACT

A method and apparatus for delivering predetermined amounts of material, the apparatus comprising a chute; a metering wheel in cooperative relation to the chute to repetitively draw discrete amount of material onto the metering wheel; an arrangement for establishing a procession of spaced apart articles along a path, a transfer wheel for repetitively transferring discrete amount of material from said metering wheel to spaces defined between adjacent pairs of articles in the procession and a cleaning wheel for removing extraneous material from the articles.

18 Claims, 11 Drawing Sheets

METHOD AND APPARATUS FOR HIGH SPEED DELIVERY OF PARTICULATE MATERIAL

FIELD OF INVENTION

The present invention relates generally to methods and apparatus for accurately delivering precisely metered amounts of particulate material repetitively during high speed manufacture of particulate-filled articles of manufacture, and most particularly, to precise, repetitive delivery of granular charcoal in spaces presented during the manufacture of plug-space-plug cigarette filters.

BACKGROUND OF THE INVENTION

Certain articles of manufacture such as charcoal cigarette filters, individual-sized packets of granular food products or condiments, capsuled pharmaceuticals, ammunition and the like require repetitive placement of precisely metered charges of particulate matter at some location along the production-line procession of the articles. Achieving sufficient speed in the mass production of such articles without sacrificing consistency, damaging the material and/or exacerbating spillage is challenging, particularly at elevated manufacturing speeds where ricochet and vibration may impair process control and consistency.

With machines of the prior art, process control usually suffers at high machine speeds from inconsistent metering and pulverization of the material, particularly in those prior machines where fast moving machine components are allowed to impinge stationary or relatively slow moving particulate material. For example, certain prior charcoal metering devices contain a supply of charcoal in a hopper and allow the rim of a rotating metering wheel to rotate through the relatively stationary collection of charcoal. Such an arrangement creates a pulverizing action upon the charcoal which generally increases with machine speed.

Excessive pulverization of the particulate material may alter the qualities of the final product unacceptably. Ricochet and escape of particulate matter during manufacturing operations with prior machines often create unacceptable deficiencies in the final product (such as smears or incomplete fillings) and precipitate undesirable machine "downtimes" to effect clean-up of the machine and the surrounding work environment.

Accordingly an object of the present invention is to provide a method and apparatus capable of precisely metering discrete amounts of particular material at high machine speeds.

Another object of the present invention is to provide a method and apparatus which executes high speed delivery of metered amounts of particulate material without pulverization of the material even at high operational speeds.

Yet another object of the present invention is to provide an apparatus for delivering particulate material, which minimizes shearing action upon the particulate material.

Still another object of the present invention is to provide a method and apparatus which minimizes shear upon the particulate material by maintaining low relative velocities between the particulate material and portions of the machine coming into contact with the particulate material.

Another object of the present invention is to provide a method and apparatus which transfers particulate material with the assistance of vacuum so as to minimize scatter and promote consistency even at high machine speeds.

Yet another object of the present application is to provide a method and apparatus which applies vacuum to remove scattered material from sites intended to be free of material so as to enhance cleanliness of operation.

Still another object of the present invention is to provide a method and apparatus for high speed delivery of particulate material with minimal escape of the material.

SUMMARY OF THE INVENTION

These and other objects are achieved with the present invention which is embodied in an arrangement for the production of plug-space-plug cigarette filters. Such apparatus and method includes a combiner for establishing two-up filter plugs in spaced relation upon a continuous stream of plug wrap; a filter rod maker downstream of the combiner for wrapping the plug wrap about the spaced apart filter plugs and sealing same; a charcoal inserter operative at a location between the rod maker and the combiner for inserting predetermined, metered amounts of granulated charcoal in the spaces defined between the placed two-up filter plugs; and a cutter downstream of the filter rod maker for cutting the continuous, charcoal filled, filter rod into discrete filter rod plugs.

In particular, the charcoal is delivered by first establishing filter plugs in spaced relation to one another along a continuous plug wrap as the plug wrap is drawn along a plug wrap path; establishing a flow of charcoal along a first path; moving a first pocket along an endless path at least partially coinciding with said first path; drawing an amount of the charcoal into the pocket as the pocket moves in proximate relationship with the charcoal flow; transferring the drawn amount of charcoal from the first pocket to a second pocket while moving the second pocket along a second endless path, which second endless path includes a second endless path portion which coincides with a path establish for the plug wrap; and drawing the amount of charcoal with the aid of vacuum from the second pocket into a space defined between filter plugs that are situated upon the plug wrap as the plug wrap moves through said coincident path portion.

Additionally, the present invention provides a further step of cleaning the filter plugs while the plug wrap remains in a substantially unfolded condition and subsequently wrapping plug wrap about the filter plugs and inserted charcoal therebetween so as to establish a continuous filter rod, which is then subsequently cut into the desired length for filter rod plugs.

BRIEF DESCRIPTION OF THE DRAWING

These and other objects and advantages of the invention will become apparent upon the consideration of the following detailed description, taken in conjunction with the accompanying drawings, in which each particular reference numeral consistently refers to particular parts throughout. The following figures are included.

DETAILED DESCRIPTION OF THE PREFERRED EMBODIMENTS

Figure 1:
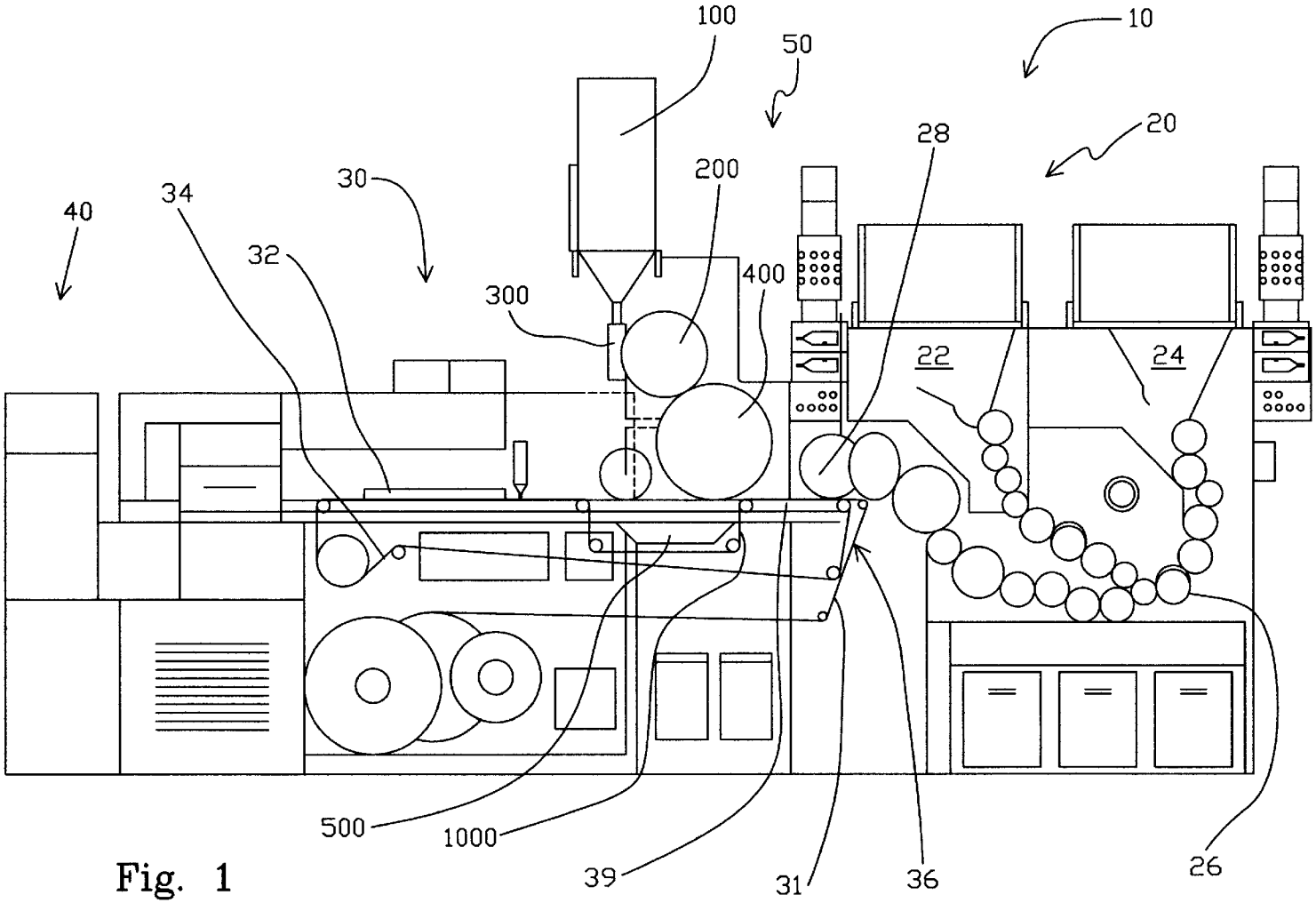
FIG. 1 is a schematic side view of a filter rod maker constructed in accordance with a preferred embodiment of the present invention.

A preferred embodiment of the present invention includes a filter rod maker 10 which is capable of the high-speed construction of plug-space-plug charcoal filter rods at a rate of approximately 300 meters of filter rod per minute. The filter rod maker 10 comprises a combiner 20 for placement of individual filter plugs in a spaced apart procession, one after another, onto a continuous tape of plug wrap; a filter rod maker 30 located downstream of the combiner 20 for wrapping the plug wrap about the spaced apart plugs to form continuous filter rod; a cutter 40 for slicing the continuous rod produced by the filter rod maker 30 into individual filter plugs of a predetermined length (usually a multiple of what constitutes a filter for a single cigarette); and a charcoal inserter 50 operatively located between the combiner 20 and filter rod maker 30 which is arranged to consistently deliver predetermined amounts of particulate charcoal into the spaces defined between adjacent pairs of plugs in the procession established by the combiner 20.

The combiner 20 is of a layout familiar to those of ordinary skill in the pertinent art, such as a GC apparatus from Hauni-Körber AG of Hamburg, Germany. GC combiners include first and second hoppers 22 and 24 and a plurality of drums 26 which cooperate to place two-up filter plugs one after another in succession at the exit 28 of the combiner 20. The combiner 20 delivers the filter plugs onto a continuous tape of plug wrap 31. The plug wrap 31, together with the spaced apart filter plugs are drawn by a garniture belt 34 along a first horizonal path through the charcoal inserter 50 and then through the garniture 32 of the filter rod maker 30. The pathway of the garniture belt 34 is configured to include a retracted path portion 1000 where the garniture belt 34 is spaced away from the plug wrap 31 so as to facilitate placement of a vacuum manifold 500 at the charcoal inserter 50. Such arrangement applies vacuum directly to the underside of the plug wrap 31 as it passes through the charcoal inserter 50.

Preferably, a glue applicator 36 applies a tack line (or plural tack lines) along the plug wrap 31 along the side which comes into contact with the spaced apart filter plugs so as to retain the plugs in their relative positions along the plug wrap 31.

Referring now to FIGS. 1 and 2, the spaced apart filter plugs 5 (as established by the combiner 20), together with the plug wrap 31 are drawn through an entry rail 39 of the charcoal inserter 50 where metered amounts of ganular (particulate) charcoal are inserted into the spaces 7 defined between adjacent pairs of the filter plugs 5. The charcoal inserter 50 preferably comprises a charcoal reservoir 100 for the retention of a supply of particulate charcoal 110; a metering wheel 200 having a plurality of spaced-apart, preferably conical pockets 210 along its rim 204 for receiving and releasing predetermined amounts (charges) of charcoal; a chute 300 in communication with the reservoir 100 and arranged to receive an edge portion 201 of the metering wheel 200 for directing a stream of charcoal from the reservoir 100 into a confluent relationship with the edge portion 201 of the rotatable metering wheel 200; a rotatable transfer wheel 400 having a plurality of spaced-apart, preferably conical pockets 410 along its rim 404 for repetitively receiving charges of charcoal from the metering wheel 200 and releasing same to a space 7 defined between a pair of adjacent filter plugs which are passing adjacent the transfer wheel 400 along the entry rail 39; a vacuum manifold 500 beneath the entry rail 39 for facilitating a complete and clean transfer of charcoal from the transfer wheel 400 to the adjacent space 7; and a rotatable cleaning wheel 600 for pneumatically sweeping extraneous material (including any escaped charcoal) from the filter plug 5.

Figure 2A:
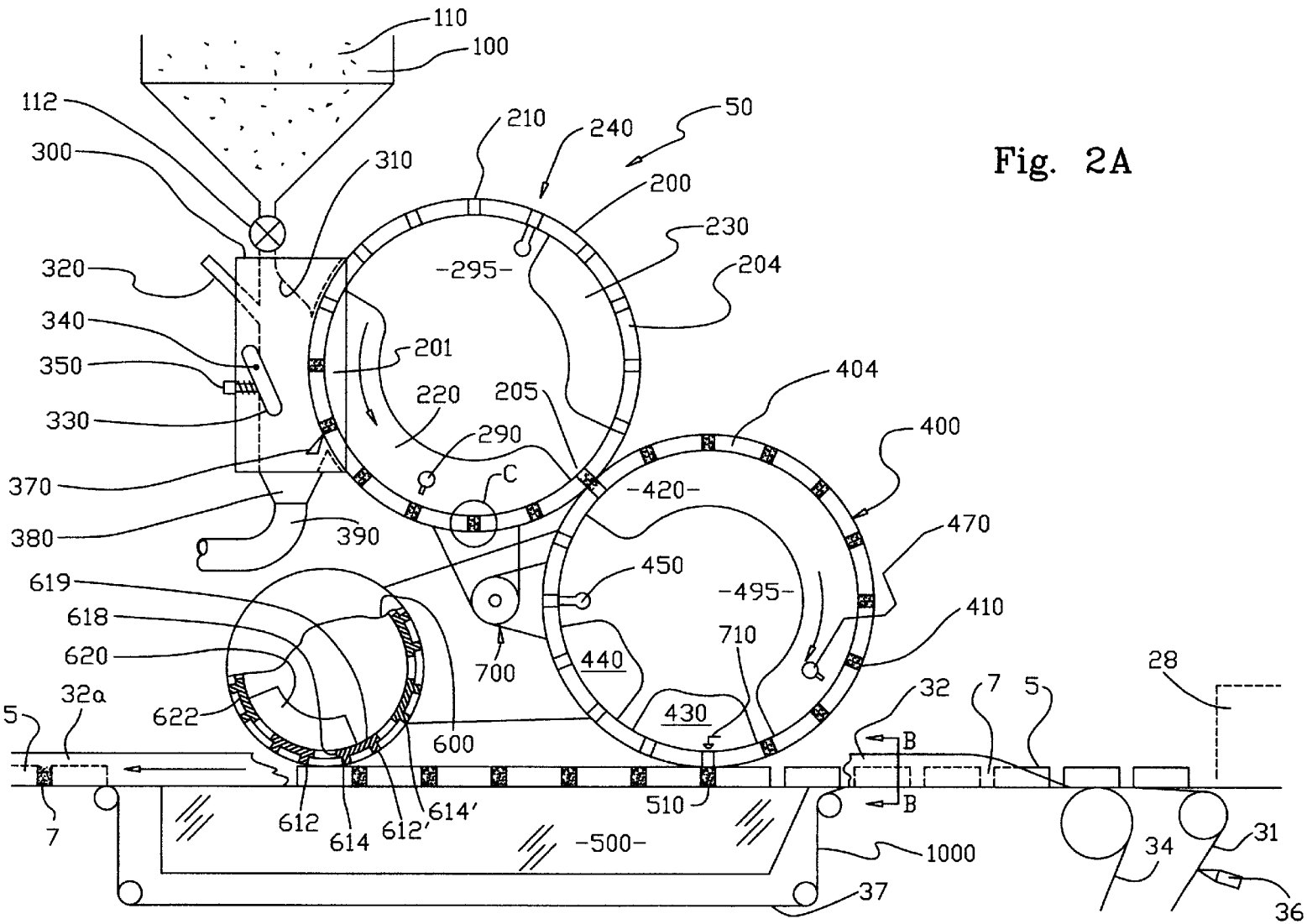
FIG. 2A is a schematic side view of the charcoal inserter of the filter rod maker of FIG. 1.
Figure 2B:
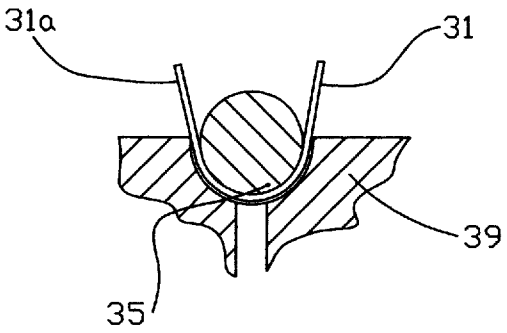
FIG. 2B is a cross-sectional detail of the entry rail taken along line B—B in FIG. 2A.
Figure 2C:
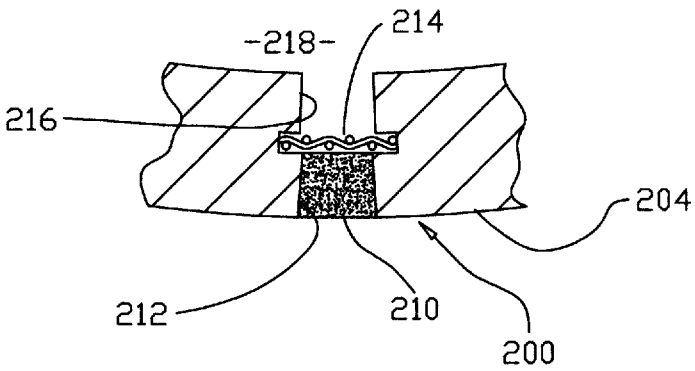
FIG. 2C is a cross-sectional detail of the metering wheel rim taken at the encircled area C in FIG. 2A.

Referring particularly FIGS. 2A and 2C, the rim 204 of the metering wheel 200 includes a plurality of equally spaced-apart pockets 210, each of which are defined by a radially directed, conical bore 212 and a screen 214 at the terminis of the conical bore 212. The conical bore 212 is convergent in the radially inward direction. A radially directed channel 216 within the rim 204 communicates a backside of the screen 214 with the interior of the metering wheel 200. The arrangement is such that when a vacuum is communicated from the interior of the wheel 200 through the passageway 216 and screen 214, any charcoal that is adjacent the pocket 210 charcoal will be drawn into the conical bore 212 of the pocket 210 until it is filled. The space enclosed by the screen 214 and the conical bore 212 define the volumetric capacity of each pocket 210.

Optionally, the screen 214 is affixed upon a threaded ring or upon a ring that engages selectable annular spacers so that the radial position of each screen 214 may be adjusted to accommodate delivery of a selectable range of volumetric quantities of charcoal.

The chute 300 is in communication with the reservoir 100 of granular charcoal such that the charcoal can be controllably passed from the reservoir 100 through the chute 300 under the influence of gravity. At a location along the internal passage way 310 through the chute 300, a vent 320 is arranged to admit ambient air into the passageway 310 as the particulate charcoal 110 is drawn under vacuum from the chute 300 into the pockets 210 of the metering wheel 200. At a second location along the passage way 310 below the vent 320 is situated a baffle 330, which is arranged along the passage way 310 so as to deflect the stream of entrained charcoal toward the adjacent edge portion 201 of the metering wheel 200.

The chute 300 includes a doctoring blade 370 at a location along the passage way 310 near where the rim 304 of the metering wheel exits the chute 300 and is operative upon the metering wheel 200 so as to remove any extra granular charcoal that extend beyond the confines of the pockets 210 as the metering wheel 200 rotates the pocket out 210 of the chute 300. Such arrangement assures a consistent and clean filling of the pockets 210 as they are rotated through the chute 300. The doctored (extra) charcoal is redirected back into the passageway 310. At the exit of the passageway 310, a trap 380 receives the granular charcoal that was not collected by the metering wheel 200, which duct 380 is in communication with the appropriate arrangement 390 for returning the uncollected charcoal to the reservoir 100.

A shut-off valve 112 is positioned operatively between the reservoir 100 and the entrance to the chute 300. Optionally, the shut-off valve 112 could be configured as a metering valve or the like.

Fixed within the confines of the metering wheel 200 is a first vacuum plenum 220 which is operative about an angular extent of the wheel 200 beginning where charcoal is collected from the chute 300 and ending at an angular transfer location 205 where charcoal is transferred from the wheel 200 to the wheel 400. The vacuum plenum 220 is connected to a vacuum source through ducting and preferably extends from an approximately 10 o'clock angular position along the rim 204 just prior to entry of the rim 210 into the chute 300 to an approximately 5 o'clock angular position along the rim 204, where the rim 204 of the metering wheel 200 converges with the rim 404 of the transfer wheel 400. As each pocket 210 passes along the vacuum plenum 220, vacuum within the plenum 220 is communicated through the channel 216 of the pocket so that charcoal is drawn into and retained by the pocket 210. Accordingly, as the individual pocket 210 passes along the plenum 220, it is subjected to negative pressure tending to draw granular charcoal into the pocket 210 as it passes through the chute 300 and retains the pocket-load of granular charcoal until such time that the pocket 210 passes the angular transfer location 205 (the 5 o'clock position), whereupon communication with the vacuum is relieved. After further rotation of the rim 204, the pocket 210 is then communicated with a second vacuum plenum so that any material lingering in the pocket 210 is retained within the pocket 210 until such time that the pocket 210 arrives at the purging station 240 (at or about a 2 o'clock position on the metering wheel 200), where a positive flow is directed through the channel 216 of the pocket 210 so as to cleanse the pocket 210 of any extraneous matter before the pocket returns to the chute 300. Any material removed at the purging station is collected so as to avoid contamination of product and the machine 10.

As the pockets 210 move across angular positions outside of the first and second plenums 220 and 230, the internal drum structure 295 within the wheel blocks off the channel 216 from communication with the plenums 220 and 230. The internal drum structure 495 within the transfer wheel 400 is provided between the plenums 420, 430 and 440 in similar fashion with respect to the pockets 410 at the rim 404 of the transfer wheel 400.

As each loaded pocket 210 is rotated beyond the end of the vacuum plenum 220 (the 5 o'clock position), the communication of vacuum is interrupted such that the charcoal within the pocket 210 may be readily removed and transferred to one of the pockets 410 located at space locations about the rim 404 of the transfer wheel 400. The transfer wheel 400 rotates in a direction opposite of the metering wheel 200 and its rim 404 passes by the rim 204 with clearance of approximately 0.4 millimeter at an angular location of approximately 11 o'clock on the transfer wheel 400.

The rim 404 of the metering wheel 400 includes a plurality of equally spaced-apart pockets 410, each of which are constructed in similar fashion to the pockets 210 of the metering wheel 200. Referring particularly to FIG. 2C, with the understanding that the last two digits in designations of comparable elements are the same, each pocket 410 includes a radially directed, conical bore 412 and a screen 414 at the terminis of the conical bore 412. The conical bore 412 is convergent in the radially inward direction and of slightly larger diameter than the conical bore 212 of the metering wheel 200. A radially directed channel 416 within the rim 404 communicates a backside of the screen 414 with the interior of the transfer wheel 400.

At a 6 o'clock angular location on the transfer wheel 400, the rim 404 of the wheel 400 comes into slight contact with an adjacent pair of filter plugs 5 moving along the entry rail 39. Preferably, the transfer wheel 400 and the procession of filter plugs 5 are adjusted relative to one another such that as each of the pockets 410 arrive at the 6 o'clock angular location, it is situated directly above one of the spaces 7 provided between adjacent pairs of filter plugs 5. The spacing between the pockets 410 is selected such that this relationship with the spaces 7 repeats itself as each pair of the filter plugs 5 passes beneath the transfer wheel 400 as the wheel 400 rotates.

Additionally, the spacing of the pockets 210 along the rim 204 of the metering wheel 200 is selected such and the wheels synchronized such that as each pocket 210 of the metering wheel 200 approaches the angular transfer location 205 of the metering wheel 200, one the pockets 410 of the transfer wheel 400 arrives at the 11 o'clock angular position on the transfer wheel 400 so that each pocket 210 and 410 find themselves opposite one another at the angular transfer location 205.

By the time an empty pocket 410 arrives at the 11 o'clock position on the transfer wheel 400, the pocket 410 has been communicated with the vacuum plenum 420 so that the pocket 410 draws charcoal from the opposing pocket 210 and retains same against its screen 414.

The loaded pocket 410 remains subject to the vacuum plenum 420 so as to retain the load of charcoal as it rotationally traverses from the 11 o'clock position to a position just beyond a 5 o'clock angular location about the transfer wheel 400, where the pocket 410 comes into vertical alignment over one of the spaces 7 between a pair of filter plugs 5.

Upon further rotation of the transfer wheel 400, the loaded pocket moves ever closer to the respective space 7 and passes into communication with an ambient plenum 430 which is vented to the surrounding environment so as to communicate ambient pressure to the pocket 410. By such arrangement, charcoal is more readily removed from the pocket 410 with minimal or no scatter.

After the pocket 410 has passed through the 6 o'clock position and its contents transferred into the space 7, the pocket 410 passes into communication with a second vacuum plenum 440 which retains any lingering particulate matter within the pocket 410 until such time that it arrives at a purging station 450, where a stream of air is blown through the pocket 410 to purge same of any extraneous material before it arrives at the 11 o'clock position to receive another charge of charcoal from the metering wheel 200.

Referring now to FIGS. 2A and 2B, as the plugs 5 are transferred onto the garniture belt 34 together with the porous plug wrap 31, the garniture belt 34 is directed along a path portion 37 which is spaced apart from the path of the plug wrap 31. The plug wrap 31 and filter plugs 5 continue along their linear path pursuant to guidance from the entry rail 39. The routing of the garniture belt 34 along the spaced apart path 37 accommodates the placement of a vacuum manifold 500 adjacent the guide rail 39 so that a vacuum may be communicated more directly to the spaces 7 through the porous plug wrap 31 as the plugs 5 move through the location 510 beneath the 6 o'clock position of the transfer wheel 400. The vacuum induced in the vacuum manifold 500 is communicated through an elongate slot 520 in the entry rail 39 to the underside of the plug wrap 31. Upstream of the location 510, folding surfaces of the entry rail 39 causes the plug wrap 31 to be partially folded about the plugs 5 so that longitudinal edge portions 42 of the plug wrap 31 extend upwardly sufficiently to retain charcoal within the spaces 7. The communication of vacuum to the spaces 7 as the procession of filter plugs passed beneath the transfer wheel 400 contributes a positive withdrawal of charcoal from the pockets 410 of the transfer wheel 400 into the spaces 7 and positively retains the charcoal loading in the space 7 as the procession of filter plugs proceed toward the cleaning wheel 600.

The cleaning wheel 600 has a rim 604 which is synchronized to rotate with the metering wheel 200 and the transfer wheel 400 such that pairs of partitions 612 and 614 engaged opposite end portions of each filter plug 5 as each plug 5 passes beneath the cleaning wheel 600. A channel 618 communicates the space defined by the partitions 612 and 614 and the plug 5 with a vacuum plenum 620 which is at a fixed angular location extending from about a 5 o'clock position to about an 8 o'clock position about the cleaning wheel 600. The arrangement draws a vacuum upon the surfaces of the filter plug 5 beneath the cleaning wheel 600 to draw away any extraneous charcoal or other particulate matter they may have landed upon the plug 5. The rim 604 of the cleaning wheel 600 includes closed-off sections 619 which repetitively rotate into placement over the filled spaces 7 as they pass beneath the cleaning wheel 600 to prevent communication of vacuum to the spaces 7.

Once the continuous procession of filter plugs 5 have been charged with charcoal and cleaned, the procession proceeds further to the garniture 32 for a completion of the sealing and wrapping of the plug wrap about the filter plugs 5 in accordance with technique practiced throughout the industry. Referring back to FIG. 1, this part of the process includes the application of an adhesive along the edge portion 32*a* of the plug wrap at the glue applicator However, just downstream of the cleaning wheel 600, the garniture belt 34 is returned to its pathway adjacent to the path of the plug wrap 31 and plugs 5 so as to pull same through the garniture 32.

Referring again to the metering wheel 200 and the transfer wheel 400 are provided with air jets 290 and 470, respectively, which are operated during shut down of the charcoal inserter 50 to clear the wheel rims 204 and 404 of extraneous matter in the pockets 210 and 410. The air jets 290 and 410 are positioned such that charcoal in the system is blown from the wheels 200 and 400 before delivery to the next station in the system. The discharges from the air jets 290 and 470 are collected in traps (not shown), and the air jets 290 and 470 are not operated during production operation of the charcoal inserter.

The metering wheel 200, the transfer wheel 400 and the cleaning 600 are synchronously driven by timing belt and pulley arrangements generally designated 700 at 1:1:1 ratios. A sensor 710 located at the 6 o'clock position on the transfer wheel 400 is arranged to sense arrival of a pocket 410 thereat so that at the beginning of operations, the garniture belt 31 and the transfer wheel 400 may be adjusted in position relative to one another so that one of the pockets 410 is positioned directly over a space 7 when it arrives at the 6 o'clock position. During operation of the charcoal inserter 50, signals from the sensor 710 are processed to monitor the rotational of the wheel 400 so that the phase relationship between the arrival of the pockets 410 at the 6 o'clock position and that of the spaces 7 in the procession of the filter plugs 5 is maintained either by incremental adjustments in the speed of the garniture belt 34 and/or by incremental adjustments in the speed of the wheel 400. It is to be noted, however, that for different lengths of the filter plugs 5, the relative speed of the transfer wheel 400 and the garniture belt 34 must be adjusted in order to achieve the aforementioned phase relationship between the pockets 410 and the spaces 7.

Figure 3A:
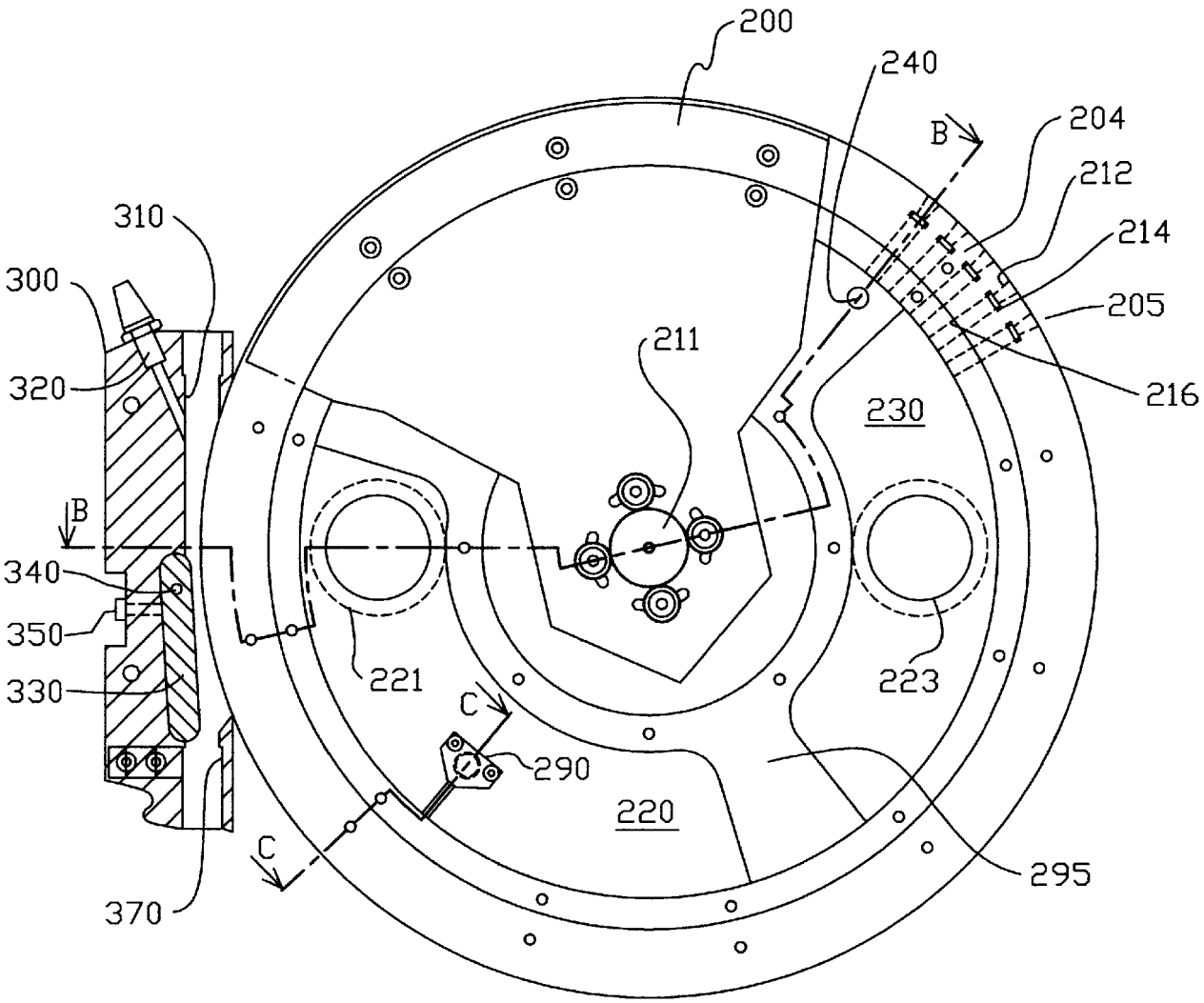
FIG. 3A is a detailed, partially cut-away side view of the metering wheel of the charcoal inserter of FIG. 2A.
Figure 3B:
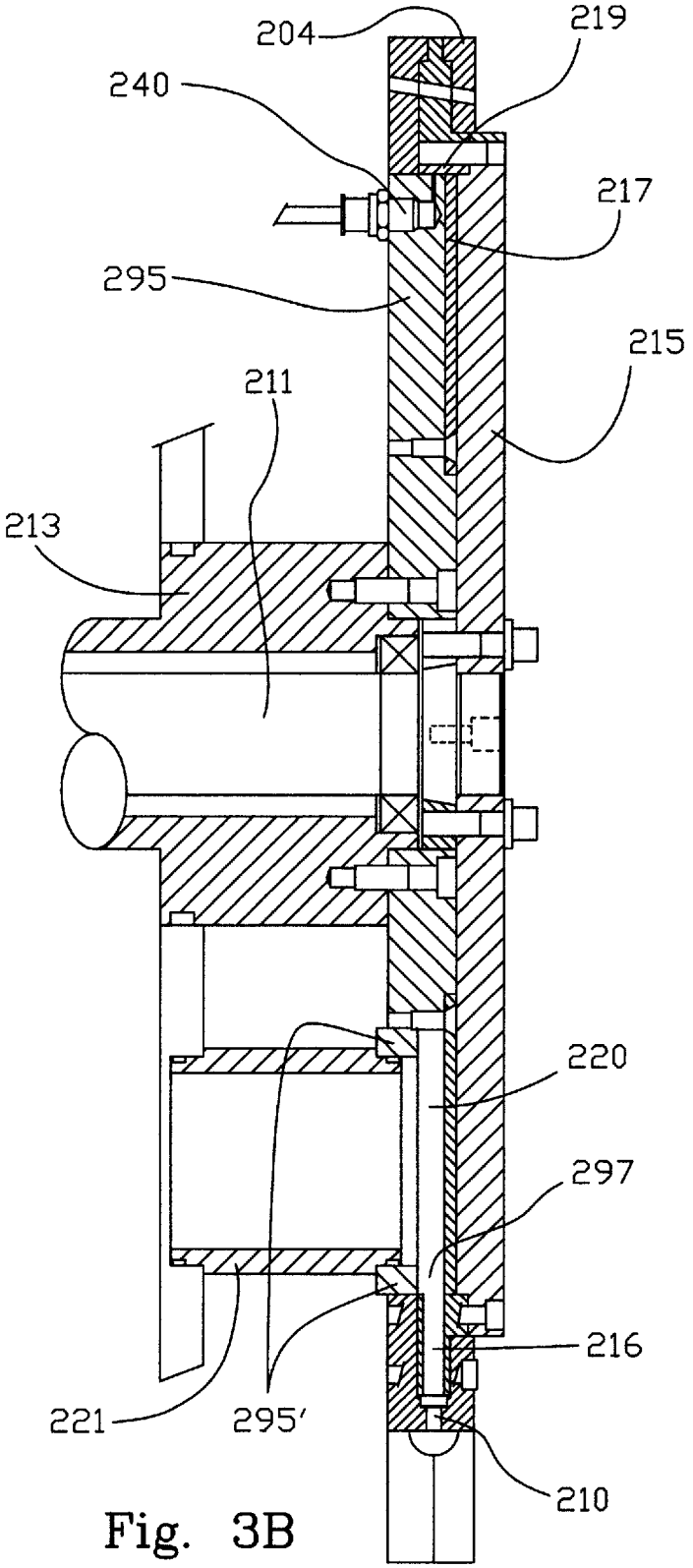
FIG. 3B is a sectional side view along line B—B in FIG. 3A.

Referring now to FIGS. 3A and 3B, a layout of a metering wheel 200 and chute 300 constructed in accordance with the preferred embodiment includes a drive shaft rotatably mounted within the framework 213 of the charcoal inserter 50, which drive shaft 211 is coupled to a frontal wheel disk 215 such that the wheel disk 215 rotates therewith. At the perimeter of the wheel disk 15, a rim 204 is bolted so as to rotate with the disk 215. The metering wheel 200 further comprises an annular, steel plate 217 which provides a sealing surface for the disk 215. The plate 217 is affixed to the stationary internal drum structure 295 within the metering wheel 200, and minimal clearance is established between the plate 217 and the disk 215. The drum structure 295 is affixed to the framework 213 of the charcoal inserter 50.

Referring particularly to FIG. 3B, the plenums 220 and 230 are enclosed by portions of the annular plate 217 and adjacent portions 295' of the internal drum structure 295 of the metering wheel 200. Ducts 221 and 223 communicate the plenums 220 and 230, respectively, with a source of vacuum such as a vacuum pump of exhaust fans and the like. The internal drum structure 295 is provided a slot 297 throughout the annular extent of the plenums 220 and 230 so as to permit communication of the plenums 220 and 230 with the pockets 210 through the channels 216.

When setting the wheels 200 and 400 in alignment with one another, a pocket 210 at the angular transfer location 205 and the rotational axis of the metering wheel 200 are aligned with an opposing pocket 410 adjacent the angular transfer location 205 as well as the rotational axis of wheel 200.

Figure 3C:
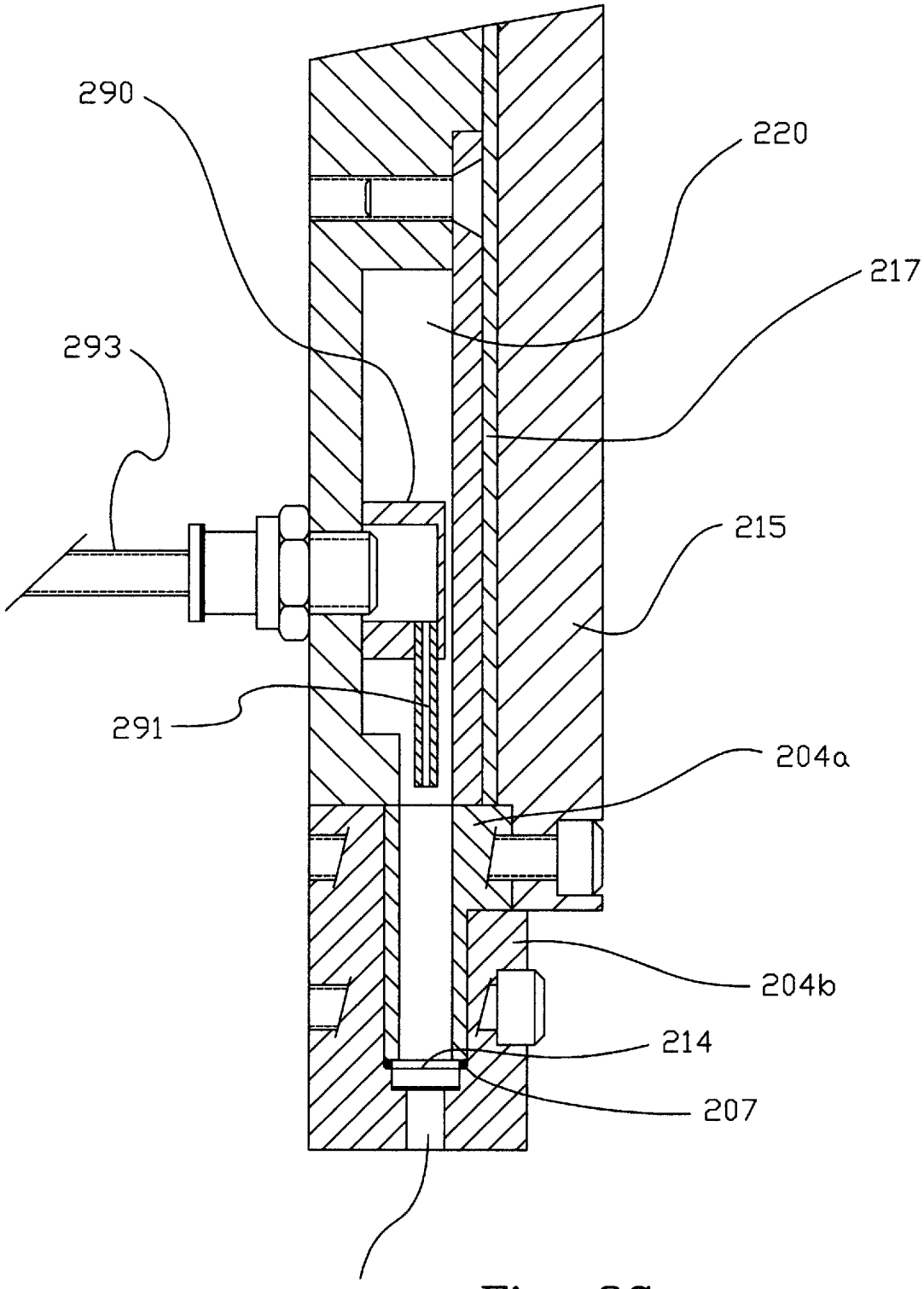
FIG. 3C is a sectional detail taken along line C—C in FIG. 3A.

Referring now to FIG. 3C, the air jet 290 includes an elongate nozzle 291 which is radially aligned with the channel 216 of each pocket 210 as they come into alignment with the air jet 290. A duct 293 communicates a source of air to the air jet 290 which is supplied only during shut down-operation of the charcoal inserter 50.

Still referring to FIG. 3C, the rim 204 is constructed from a first annular member 204*a* into which is drilled the radial passageways 216 of the pockets 210. Preferably the annular member 204*a* is bolted to the perimeter of the disk 215. A second annular member 204*b* is bolted to the first annular member 204*a* and includes conical bores 212 defining the pockets 210. The screens 214 of each pocket 210 is held in placed between members 204*a* and 204*b* on a ring 207. The rings 207 may come in selectable sets which differ from each other as to how deeply they establish the screen 214 within the rim 204 so as provide selectability for the volumetric cacities of the pockets 210.

Figure 4A:
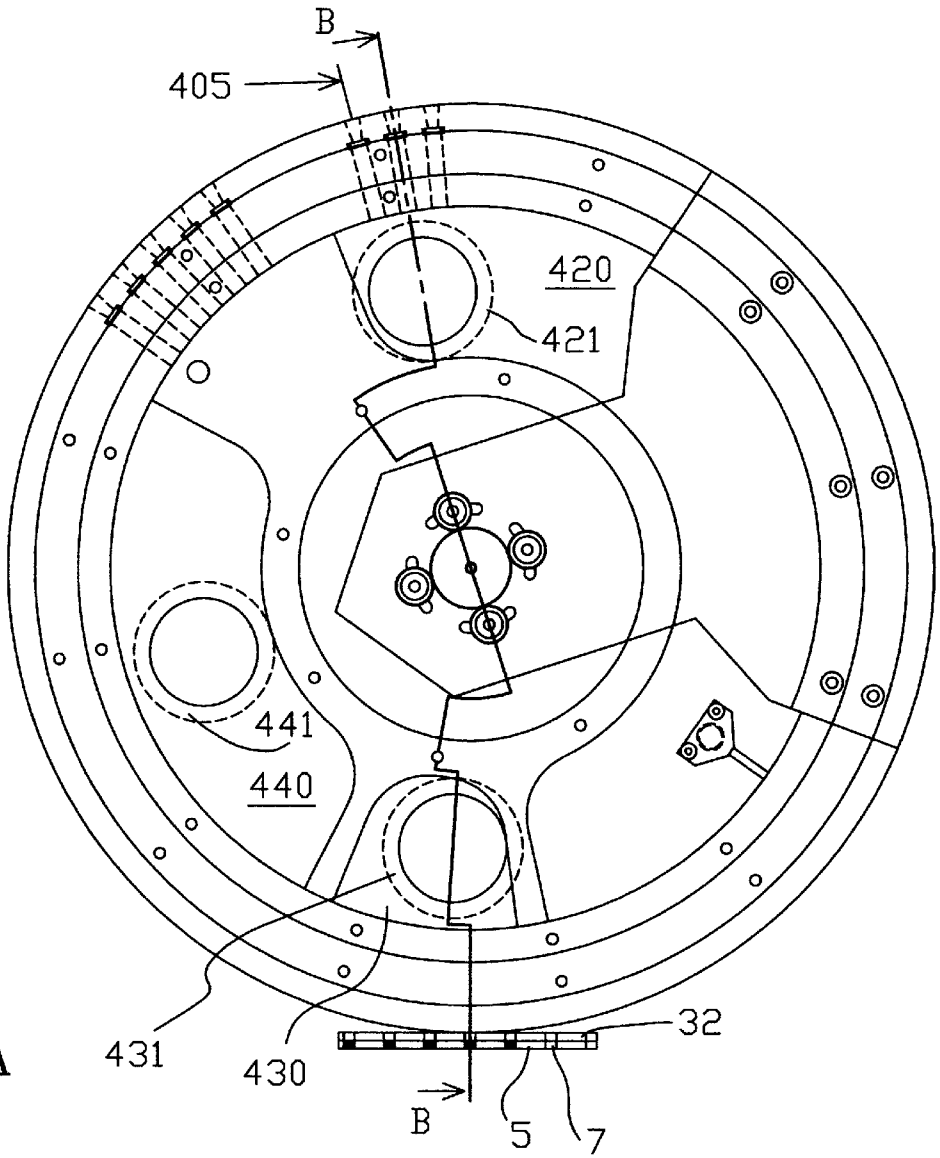
FIG. 4A is a detailed, partially cut-away side view of the transfer wheel of the charcoal inserter of FIG. 2A.
Figure 4B:
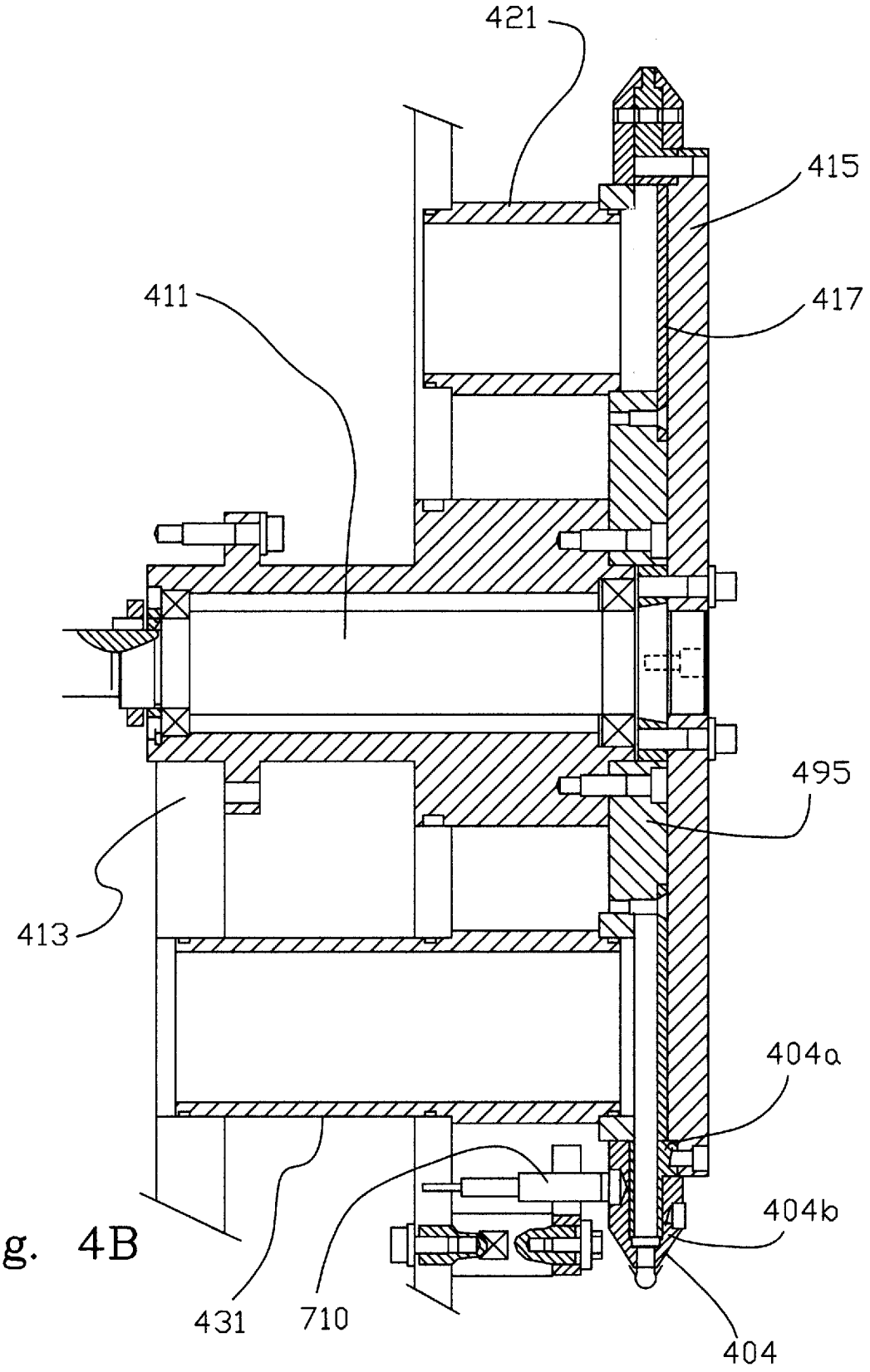
FIG. 4B is a sectional side view of the transfer wheel along line B—B in FIG. 4A.

Referring now to FIGS. 4A and 4B, the mechanical layout of a transfer wheel 400 constructed in accordance with the preferred embodiment includes a frontal rotatable disk 415 which affixed to a drive shaft 411. Secured to the outer periphery of the rotatable disk 415 is the rim 404 which is constructed from a first annular member 404*a* into which is defined the channels 418 leading to the pockets 410, a second annular member 404*b* which includes fluted bores which together with the screens 414 define the pockets 410. The frontal disk 415 and the rim 404 rotate about the drum structure 495 of the transfer wheel 400, which is affixed to the general framework 213 of the charcoal inserter 50. An annular slip plate 417 provides a bearing surface for the rotatable disk 415. The annular slip plate 417 is affixed to the drum structure 495, which together define the plenums 420, 430, and 440. The vacuum plenums 420 and 440 are communicated with vacuum sources through ducts 421 and 441 respectively, whereas the ambient plenum 430 is communicated to the surrounding environment through a duct 431.

Referring particularly to FIG. 4B, a proximity sensor 710 is fixed at the 6 o'clock position of the transfer wheel 400. The rim 404 of the wheel 400 is provided with a plurality of markers (preferably in the form of bores) which are detectable by the proximity sensor 710 at each location of a pocket 410 so as to provide signals upon the arrival of a pocket at the 6 o'clock position.

Figure 5A:
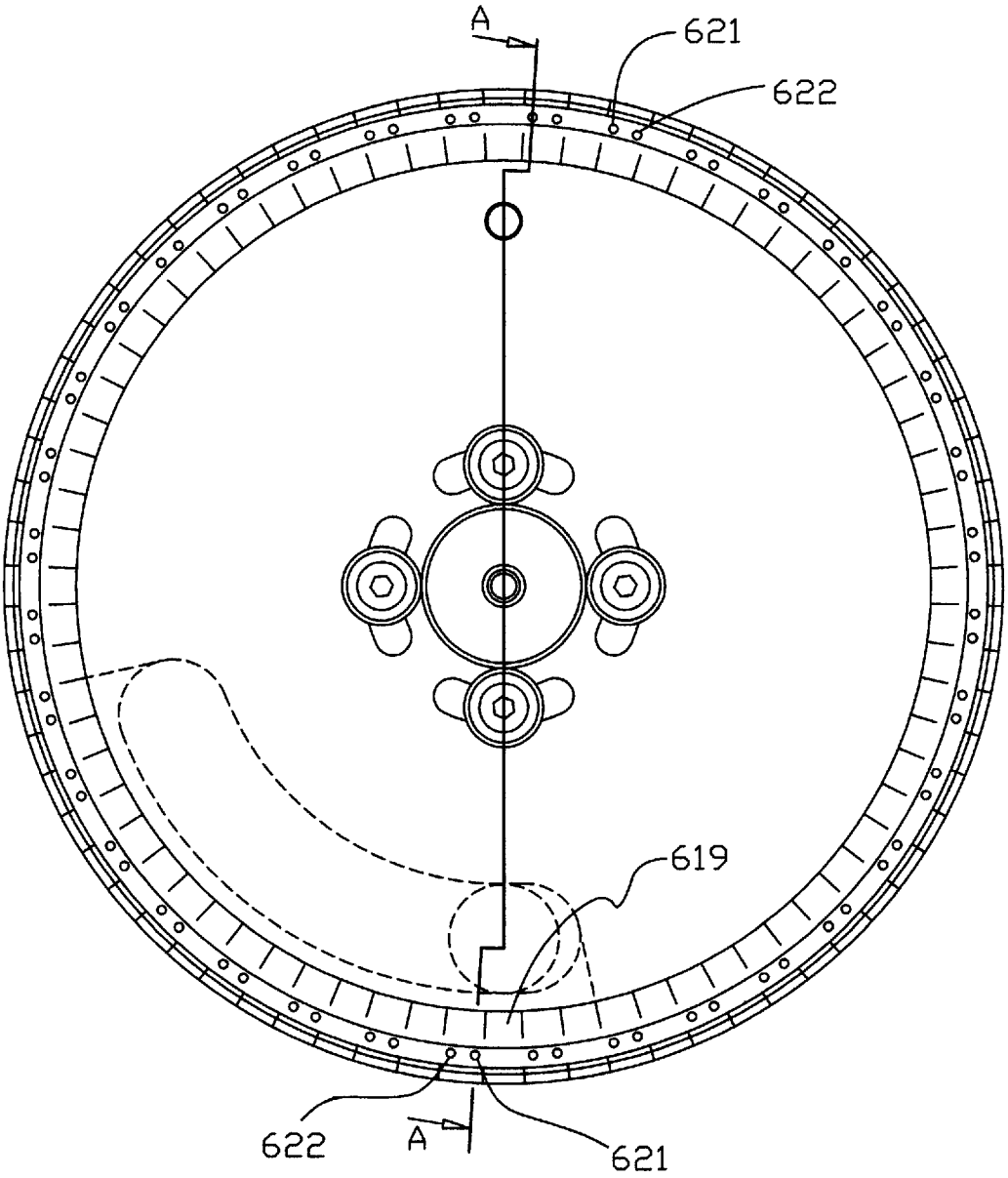
FIG. 5A is a detailed side view of the cleaning wheel of the charcoal inserter of FIG. 2A.
Figure 5B:
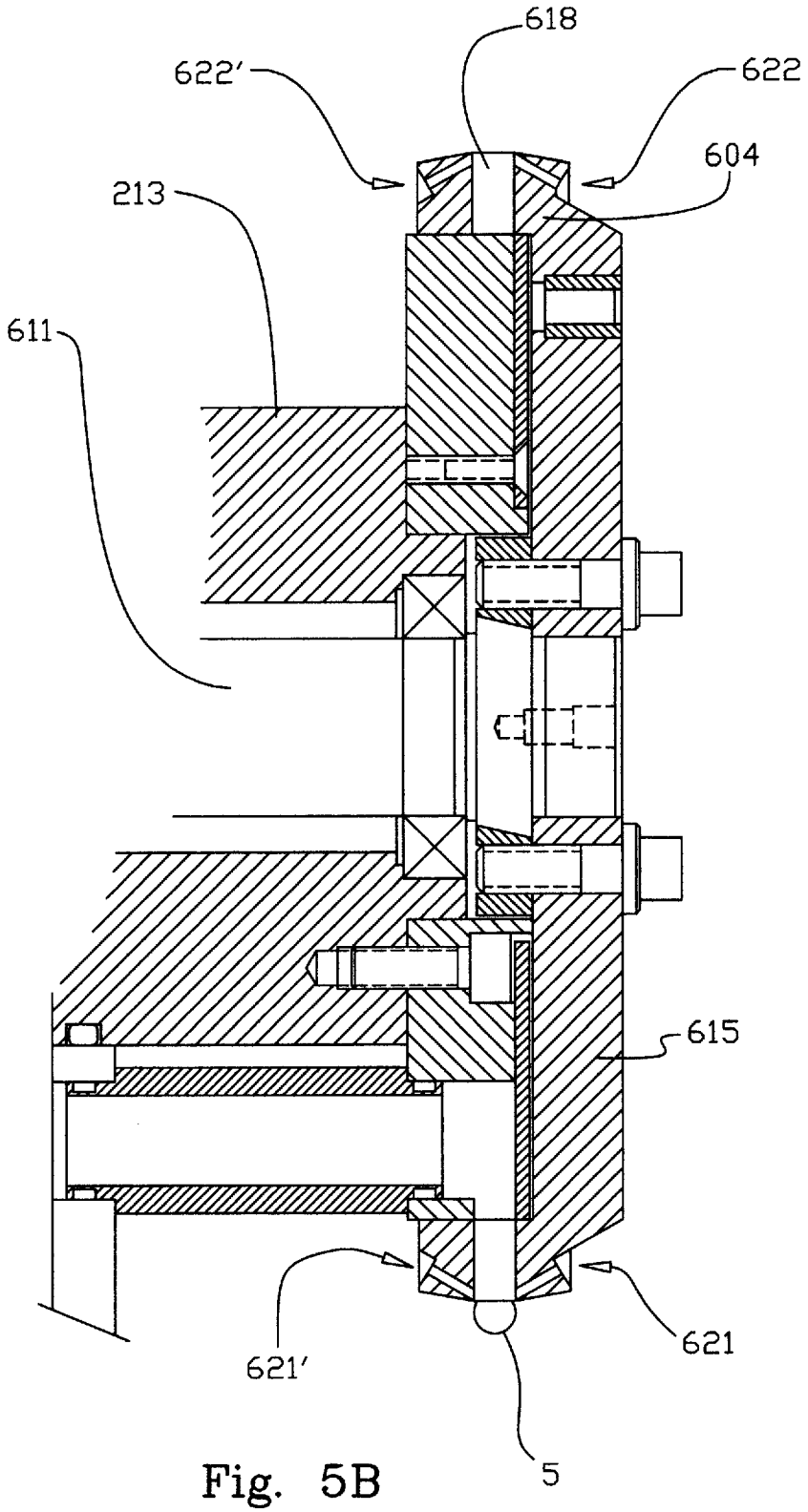
FIG. 5B is a sectional side view of the cleaning wheel of FIG. 5A.

Referring now to FIGS. 5A and B, the cleaning wheel 600 preferably comprises a drive shaft 611 which is rotatably supported by the general framework structure 213 of the charcoal inserter 50. A frontal rotatable disk 615 is attached to the drive shaft 611 so as to rotate therewith. The frontal disk 615 includes a rim 604 which include a plurality of spaced apart, radially directed cleaning ports 618 which communicate with the vacuum plenum 620 as they rotate to the angular extent of the plenum 620. Opposing pairs of side portals 621, 621' and 622, 622' are provided adjacent each cleaning port 618 for admitting air obliquely through the sides of the rim 604 into the cleaning port 618 so that a sweeping stream of air is directed over the plugs 5 as they are cleaned and so that the tendency of the vacuum to draw filter plugs 5 into the cleaning wheel 600 is minimized.

The cleaning wheel 600 includes an annular plate 617 which provides a sealing surface for the rotatable frontal disk 615.

Referring now also to FIG. 2A, between each pair of cleaning port 618, the rim structure 604 includes closed-off sections 619 to prevent communication of vacuum to the filled pockets 7 between the filter plugs 5.

Figure 6:
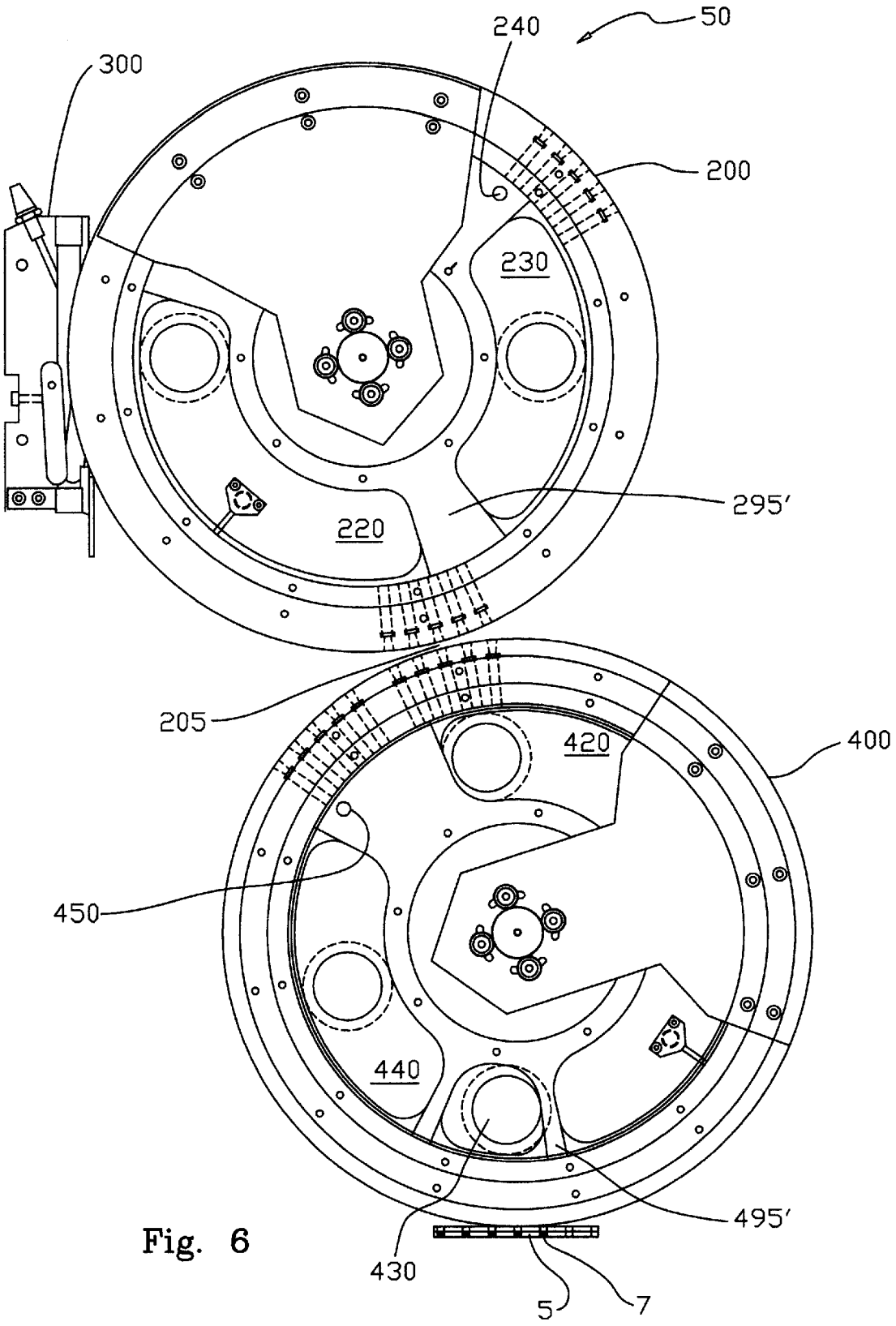
FIG. 6 is a side view of the metering wheel of FIG. 3A and the transfer wheel of FIG. 4A in operational alignment with each other.

Referring now to FIG. 6, in operation, charcoal enters the chute 300 under the influence of gravity and is deflected off the baffle 330 such that the granular charcoal circulates about the periphery of the portion of the rim 204 of the metering wheel entering the chute 300. Internally, the pockets 210 rotate into communication with the first vacuum plenum 220 as the pockets 210 enter the chute 300 so as to draw charcoal from the passage way 310 of the chute 300 into each of the pockets 210. As the pockets 210 rotate out of the chute 300, the doctor blade 370 at the exit thereof removes excess charcoal that may extend beyond the outer periphery of the rim 204. The pockets so loaded with charcoal, continue on their angular path under the influence of the vacuum from the vacuum plenum 220 until arriving at the angular location 205 where transfer to the wheel 400 takes place. Thereat communication between the pocket 210 and the plenum chamber 220 is interrupted as the channel 216 of the pocket 210 becomes blocked by a portion 295' of the drum structure within the metering wheel 200.

At the same time, empty pockets 410 of the transfer wheel 400 approaches the angular location 405 in direct opposing relation to the aforementioned loaded pocket 210 of the metering wheel 200. However, just prior to angular position 405, the empty pocket of the transfer wheel 400 is communicated with the first vacuum plenum 420 so that air together with the charcoal content of the adjacent load pocket 210 is drawn into the pocket 410. The transfer is immediate and complete, whereupon the loaded pocket of the 410 of the transfer wheel remains under the influence of the vacuum plenum 420 until arrival just before the 6 o'clock position above the precession of filter plugs 5.

As the loaded pocket 410 of the transfer wheel 400 approaches a proximal position above one of the spaces 7 between adjacent pairs of filter plugs 5, communication with the vacuum plenum 420 is interrupted by an adjacent portion 495' of the drum structure within the transfer wheel 400 and inertia and gravity are allowed to act upon the charcoal load without resistance from vacuum. As the pocket 410 approaches the 6 o'clock position on the wheel 400, the pocket 410 is in communication with the ambient plenum 430 so that air may be drawn from the ambient manifold 430 into the vacuum manifold 500 along a path through the pocket 410 and space 7 so as to positively sweep charcoal from the pocket 410 into the space 7 gently with little or no scatter.

After delivery of the charcoal into a respective space 7, the pocket 410 continues along its angular path and comes into communication with the second vacuum plenum 440 which serves to retain any material that may have lingered in the pocket 410 until such time that the pocket arrives at the purging station 450. A similar arrangement is provided on the metering wheel 200 where after transfer of charcoal to the transfer wheel 400, the respective pockets 210 are communicated with the second vacuum plenum 230 until such time that they arrive at the purging station 240. Such arrangements minimize the dispersion of extraneous charcoal particles about the system. The discharge from the purging stations 240 and 350 are collected in manifolds, which are not shown for sake of clarity.

It is to be noted that advantageously, the device minimizes the relative speed of the pockets 210 and the charcoal as it is first picked up by the metering wheel 200, which arrangement minimizes grinding action of the wheel 200 upon the granular charcoal. Likewise, transfer from the metering wheel 200 to the transfer wheel 400 is also executed at low relative speeds (zero) so as to minimize grinding and spilling at that point in the operation. Likewise transfer of charcoal to the spaces 7 between the filter plugs 5 is performed at little to no relative speed so as to again minimize ricochet and spillage. Consequently, the charcoal delivery device 50 may be operated at speeds far in excess of machines in the prior art.

One skilled in the art will appreciate that the present invention may be practiced by other than the described embodiments, which were presented for purposes of illustration and not of limitation. One skilled in the art would recognize that the device and the methodologies embodied therein are adaptable to delivering various types of particulate or granular material and could be used in applications other than the filling of cigarette filters. For example, the device is readily adaptable to the filling of pharmaceutical doses, or the repetitive placement of powdered food stuffs or other powdered products into discrete packaging or containers.

What is claimed is:

1. A method of delivering predetermined amounts of flowable material, the method comprising the steps of:

establishing a moving stream of the material through a chute;

repetitively withdrawing from the moving stream discrete amounts of the material with a metering wheel;

establishing a procession of spaced apart articles along a path;

repetitively transferring said discrete amounts of material from said metering wheel directly to a transfer wheel, said transferring step including the the steps of relieving vacuum retention adjacent a transfer location along said metering wheel and establishing vacuum retention along an adjacent portion of said transfer wheel during transfer of said discreet amounts of material from said metering wheel to said transfer wheel;

repetitively transferring the discrete amounts of material from said transfer wheel to spaces defined between adjacent pairs of the articles; and removing extraneous material from the articles in the procession after said transfer step to said spaces.

2. An apparatus for delivering predetermined amounts of material, the apparatus comprising a chute; a metering wheel in cooperative relation to the chute to repetitively draw discrete amounts of material from the chute onto the metering wheel; means for establishing a procession of spaced apart articles along a path, a transfer wheel for repetitively transferring discrete amounts of material from said metering wheel to spaces defined between adjacent pairs of articles in the procession, means for drawing the material from said transfer wheel into said spaces and a cleaning wheel adapted to remove extraneous material from the articles.

3. The apparatus as claimed in claim 2, wherein said chute is in communication with a reservoir, said chute including an air opening and a baffle at a location along said passageway, said baffle arranged to deflect the material toward a location adjacent said metering wheel.

4. The apparatus as claimed in claim 3, wherein said metering wheel comprises a rim and a plurality of radially-directed metering pockets at spaced locations about said rim, said chute including means for removing excess particular material from said metering pockets at a location adjacent said passageway.

5. The apparatus as claimed in claim 2, wherein said metering wheel comprises a rim and a plurality of radially-inwardly directed, metering pockets at spaced locations about said rim.

6. The apparatus as claimed in claim 5, wherein said rim includes a plurality of channels, said channels arranged to communicate said metering pockets with an interior of said metering wheel, said metering pockets communicating with said channels through a plurality of screens, said metering pockets following a first rotational path upon rotation of said metering wheel.

7. The apparatus as claimed in claim 6, wherein said metering wheel includes a first vacuum plenum having an angular extent inclusive of where said metering wheel is in a cooperative relation with said chute, said first vacuum plenum further extending to a transfer angular location along said first rotational path where said material is transferred from said metering wheel to said transfer wheel, said metering pockets communicating with said first vacuum plenum through said channels during rotation of said metering pockets through said angular extent of said first vacuum plenum.

8. The apparatus as claimed in claim 7, wherein said metering wheel includes a second vacuum plenum for communicating a vacuum to said pockets after their rotation through said transfer location.

9. The apparatus as claimed in claim 8, wherein said metering wheel includes a purging station operative upon said pockets after their rotation past said second vacuum plenum.

10. The apparatus as claimed in claim 2, wherein said transfer wheel comprises a rim and a plurality of radially directed transfer pockets at spaced locations about said rim, said transfer pockets following a second rotational path upon rotation of said metering wheel.

11. The apparatus as claimed in claim 10, wherein said transfer wheel rim includes a plurality of channels, said channels arranged to communicate said transfer pockets with an interior of said transfer wheel, said transfer pockets communicating with said channels through a plurality of screens.

12. The apparatus as claimed in claim 11, wherein said transfer wheel includes a transfer vacuum plenum having an angular extent inclusive of where the material is transferred from said metering wheel to said transfer wheel, said first vacuum plenum further extending to a second transfer angular location along second angular path where said material is transferred from said transfer wheel to said spaces, said pockets communicating with said transfer vacuum plenum through said channels during rotation through said angular extent of said first vacuum plenum.

13. The apparatus as claimed in claim 12, wherein said transfer wheel includes a second transfer vacuum plenum for communicating a vacuum to said transfer pockets after rotation through said second transfer angular location.

14. The apparatus as claimed in claim 13, wherein said transfer wheel includes a transfer purging station operative upon said transfer pockets after their rotation past said second transfer vacuum plenum.

15. The apparatus as claimed in claim 2, wherein said means for drawing the material into said spaces comprises a vacuum manifold in communication with said spaces as said spaces pass said transfer wheel, and an ambient plenum arranged to communicate an ambient pressure to said pockets as said spaces pass between said vacuum manifold and said pocket.

16. The apparatus as claimed in claim 15, wherein said means for establishing a procession of spaced apart articles include an endless belt, said endless belt routed away from said procession of spaced articles at a location of said vacuum manifold.

17. The apparatus as claimed in claim 2, wherein said cleaning wheel includes a vacuum manifold, means for repetitively communicating said vacuum manifold with said articles and means for repetitively isolating said spaces from said manifold as said articles pass by said cleaning wheel.

18. A method of repetitively dispensing a predetermined amount of flowable material into spaces defined between spaced apart articles, said method comprising repetition of the steps of:

establishing a stream of the flowable material in a first direction along a stream path;

establishing a procession of the spaced apart articles in a second direction along a processional path;

moving a first plurality of spaced apart receptacles along a first endless path, said first endless path including a first endless path portion in proximity to said material stream path, said step of moving said first receptacles including the step of moving said first receptacles along said first endless path portion in a direction correlating with said direction of said material stream;

drawing a portion of said material from said material stream into said first receptacles by communicating a vacuum to each first receptacle as each first receptacle moves along said first endless path portion;

after said drawing step, further applying vacuum to said first receptacles to hold the drawn, predetermined amount of material in said first receptacles while moving said first receptacles from said first endless path portion to a transfer location along said first endless path and interrupting said application of vacuum adjacent said transfer location;

moving a second plurality of spaced apart receptacles along a second endless path, said second endless path including a second endless path portion in proximity to said procession path of said articles in a direction correlating with said direction of said procession of spaced apart articles, said step of moving said second receptacles further including the step of converging said second receptacles into an opposing, adjacent relation with said first receptacle as the first receptacles are being moved through said transfer location, said adjacent second receptacles moving in a direction correlating with the direction of said first receptacles being moved through said transfer location;

drawing charcoal from the first receptacles at said transfer location to the opposing second receptacles by communicating a vacuum to said second opposing receptacle;

after said drawing step at said transfer location, further applying a vacuum to said second receptacles to retain the predetermined amount of transferred material in said second receptacles while moving said receptacle from said transfer location to said second endless path portion;

releasing said material from said second receptacles into said spaces defined between said spaced apart articles as said second receptacles move along said second path portion;

during said releasing step, drawing said material into said spaces with a vacuum; and subsequent to said releasing step, cleaning said spaced apart articles.

* * * * *